US011217404B1

(12) United States Patent
Hsieh et al.

(10) Patent No.: US 11,217,404 B1
(45) Date of Patent: Jan. 4, 2022

(54) KEYSWITCH DEVICE

(71) Applicant: Chicony Electronics Co., Ltd., New Taipei (TW)

(72) Inventors: Chao-Chin Hsieh, New Taipei (TW); Wei-Yi Lin, New Taipei (TW); Yeong-Sheng Jang, New Taipei (TW); Sung-Ying Chen, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 17/164,792

(22) Filed: Feb. 1, 2021

(30) Foreign Application Priority Data

Oct. 30, 2020 (TW) ..... 109137985

(51) Int. Cl.
*H01H 3/12* (2006.01)
*H01H 13/705* (2006.01)
*H01H 13/83* (2006.01)

(52) U.S. Cl.
CPC ..... *H01H 13/705* (2013.01); *H01H 3/122* (2013.01); *H01H 13/83* (2013.01)

(58) Field of Classification Search
CPC .... H01H 13/14; H01H 3/125; H01H 13/7065; H01H 13/704; H01H 13/04; H01H 13/70; H01H 13/20; H01H 13/50; H01H 13/52; H01H 2221/036; H01H 3/12; H01H 13/83; H01H 3/122
See application file for complete search history.

(56) References Cited

U.S. PATENT DOCUMENTS 9,502,193 B2 * 11/2016 Niu ..... H01H 11/00
2009/0000932 A1 * 1/2009 Hosokawa ..... H01H 13/12 200/344
2009/0166165 A1 * 7/2009 Aoki ..... H01H 13/88 200/333

* cited by examiner

*Primary Examiner* — Ahmed M Saeed
(74) *Attorney, Agent, or Firm* — CKC & Partners Co., LLC

(57) ABSTRACT

A keyswitch device includes a bottom plate, a keycap, and a position-returning member. The keycap includes a metal cover and a covering member. The metal cover includes a first main body. The first main body has a first surface and a second surface respectively facing toward and facing away from the bottom plate. The first surface presents a pattern. The covering member includes a second main body covering the first surface. The second main body has a light-transmitting area covering the pattern. The position-returning member is disposed between the bottom plate and the keycap and contacts the first main body.

7 Claims, 6 Drawing Sheets

341

KEYSWITCH DEVICE

CROSS-REFERENCE TO RELATED APPLICATION

This application claims priority to Taiwan Application Serial Number 109137985, filed Oct. 30, 2020, which is herein incorporated by reference.

BACKGROUND

Technical Field

The present disclosure relates to a keyswitch device.

Description of Related Art

Currently, the keyboard is one of the indispensable input devices to enter text or numbers while using a personal computer (PC). Moreover, consumer electronic products used in daily life or large-scale processing equipment used in the industrial sector require keyswitches as input devices to be operated.

Generally speaking, the surface of the keycap of each keyswitch presents a specific character for the user to recognize, and the keyboard can generate a key signal corresponding to a keyswitch after it is pressed by a user. However, after using the keyboard for a long time, the characters on the keycaps of some keyswitches tend to be worn out. In addition, according to actual measurement, during the operation of the keyboard, heat will gradually accumulate in the center of the bottom of each keycaps (that is, the top of the rubber dome), which may affect the user's pressing comfort.

Accordingly, how to provide a keyswitch device to solve the aforementioned problems becomes an important issue to be solved by those in the industry.

SUMMARY

An aspect of the disclosure is to provide a keyswitch device that can efficiently solve the aforementioned problems.

According to an embodiment of the disclosure, a keyswitch device includes a bottom plate, a keycap, and a position-returning member. The keycap includes a metal cover and a covering member. The metal cover includes a first main body. The first main body has a first surface and a second surface respectively facing toward and facing away from the bottom plate. The first surface presents a pattern. The covering member includes a second main body covering the first surface. The second main body has a light-transmitting area covering the pattern. The position-returning member is disposed between the bottom plate and the keycap and contacts the first main body.

In an embodiment of the disclosure, the metal cover further includes a first edge bending portion connected to the first main body. The covering member further includes a second edge bending portion connected to the second main body. The keycap further includes an adhesive material adhering the first edge bending portion and the second edge bending portion.

In an embodiment of the disclosure, the first edge bending portion has at least one recessed hole facing the second edge bending portion. A part of the adhesive material is accommodated in the at least one recessed hole.

In an embodiment of the disclosure, the metal cover further includes a first edge bending portion connected to the first main body. The covering member further includes a second edge bending portion and a buckling portion. The second edge bending portion is opposite to the first edge bending portion. The buckling portion is connected to the second edge bending portion and buckles an edge of the first edge bending portion away from the first main body.

In an embodiment of the disclosure, the keycap further includes an engaging structure. The engaging structure is fixed to the first main body and protrudes from the second surface. The keyswitch device further includes a connecting assembly. The connecting assembly is connected between the bottom plate and the engaging structure, and is configured to guide the keycap to move upward and downward relative to the bottom plate.

In an embodiment of the disclosure, the engaging structure is attached to the second surface and has a hollow portion. The position-returning member passes through the hollow portion to contact the first main body.

In an embodiment of the disclosure, the first main body has an engaging hole communicated to the first surface and the second surface. The engaging structure is embedded in the engaging hole.

In an embodiment of the disclosure, the metal cover further includes a supporting rib. The supporting rib is connected to the first main body and penetrates the engaging structure.

In an embodiment of the disclosure, the supporting rib protrudes from the second surface and crosses the engaging hole.

In an embodiment of the disclosure, the second main body has a non-light-transmitting area covering the engaging hole.

Accordingly, in the keyswitch device of the present disclosure, by covering the pattern of the metal cover by the covering member, the problem that the pattern is worn out after the keycap is used for a long time can be avoided. In addition, by making the position-returning member under the keycap directly contact the metal cover, the problem of heat accumulation between the center of the bottom of the keycap and the top of the position-returning member can be effectively avoided.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
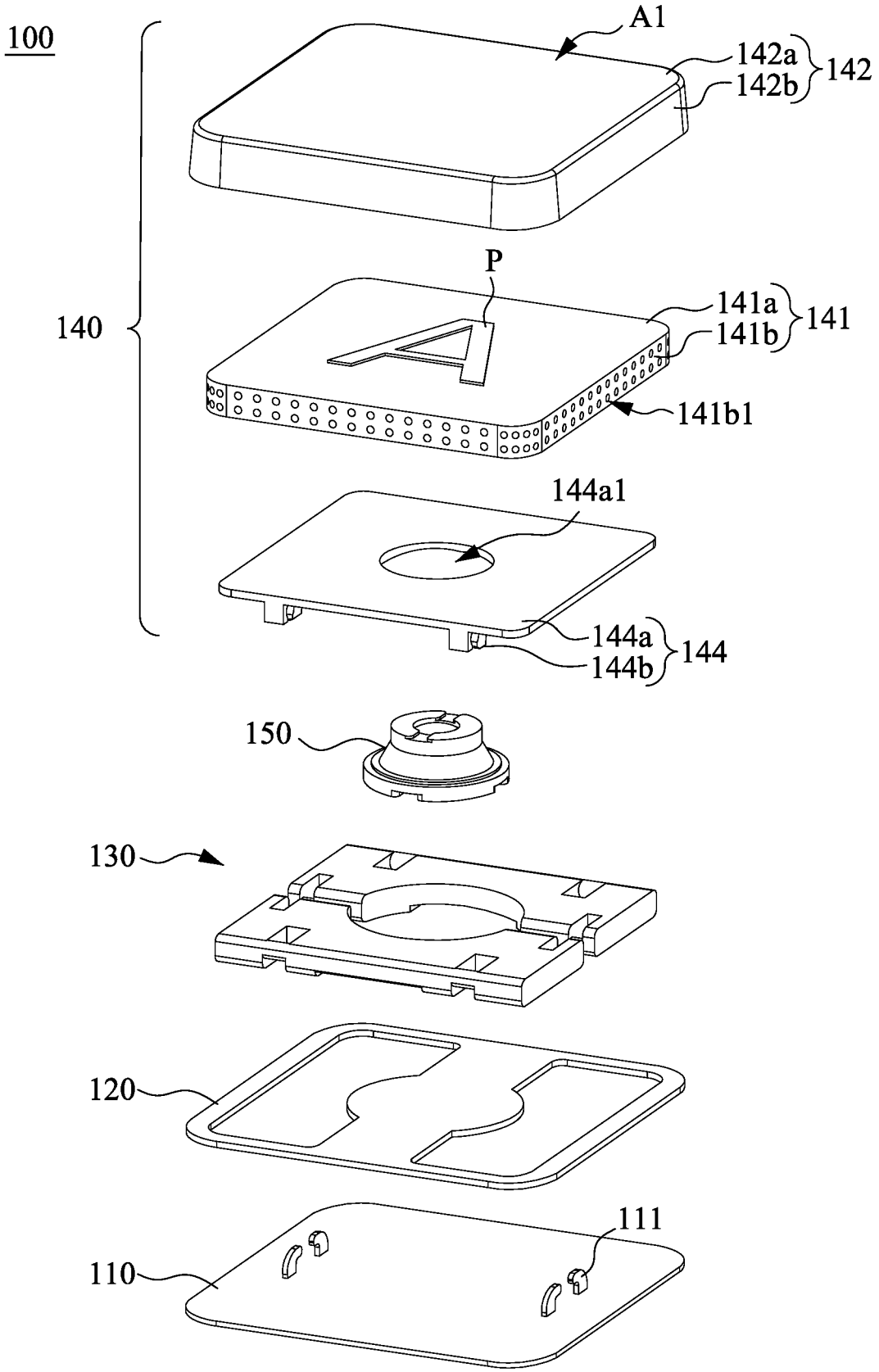
FIG. 1 is an exploded view of a keyswitch device according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts. However, specific structural and functional details disclosed herein are merely representative for purposes of describing example embodiments, and thus may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope of the disclosure.

Reference is made to FIG. 1. FIG. 1 is an exploded view of a keyswitch device 100 according to an embodiment of the present disclosure. As shown in FIG. 1, the keyswitch device 100 includes a bottom plate 110, a circuit board 120, a connecting assembly 130, and a keycap 140. The circuit board 120 is disposed on the bottom plate 110. The connecting assembly 130 is connected between the bottom plate 110 and the keycap 140, and is configured to guide the keycap 140 to move upward and downward relative to the bottom plate 110. Specifically, the bottom plate 110 has a plurality of hooks 111 passing through the circuit board 120. The keycap 140 includes an engaging structure 144 located at the bottom of the keycap 140. The engaging structure 144 includes a plurality of engaging portions 144*b*. The connecting assembly 130 is engaged between the hooks 111 and the engaging portions 144*b*.

In some embodiments, as shown in FIG. 1, the connecting assembly 130 includes two separate connecting members. Each of the connecting members is slidably engaged with the corresponding hooks 111 on the bottom plate 110, and is rotatably engaged with the corresponding engaging portions 144*b* of the engaging structure 144 (the engaging portions 144*b* form, for example, water drop holes). In other words, the connecting assembly 130 shown in FIG. 1 is a butterfly connecting structure as an example, but the present disclosure is not limited in this regard. In practical applications, the connecting assembly 130 may be replaced with other supporting structures with similar functions (that is, moving the keycap 140 upward and downward relative to the bottom plate 110), such as a scissors-like connecting structure or a two-parallel linkage structure.

As shown in FIG. 1, the keyswitch device 100 further includes a position-returning member 150. The position-returning member 150 is disposed between the bottom plate 110 and the keycap 140. Specifically, the upper and lower sides of the position-returning member 150 respectively contact the bottom of the keycap 140 and the upper surface of the circuit board 120, and a passage design is formed on the connecting assembly 130 for the position-returning member 150 to pass through. When the keycap 140 is pressed downwards by an external force, the keycap 140 will press the position-returning member 150. The position-returning member 150 correspondingly generates a counter-force to support the keycap 140, so as to provide users the feeling of pressing. When the external force applied onto the keycap 140 is released, the position-returning member 150 can provide a restoring force for returning the keycap 140 back to its highest position at which the keycap 140 is not pressed.

In some embodiments, the position-returning member 150 can be a resilient member, such as a rubber dome, but the present disclosure is not limited in this regard.

In some embodiments, the circuit board 120 is, for example, a printed circuit board, and a keyswitch circuit (not shown) is provided on the upper surface thereof. A conductive material may be disposed at the bottom of the center of the position-returning member 150. When the keycap 140 is pressed and moved toward the bottom plate 110, the position-returning member 150 will deform to make the conductive material contact the keyswitch circuit on the circuit board 120, causing the keyswitch circuit to be electrically conducted. Hence, the circuit board 120 can then generate a trigger signal corresponding to the pressed keyswitch device 100.

In some other embodiments, the circuit board 120 is, for example, a membrane circuit board, but the present disclosure is not limited in this regard. For example, the circuit board 120 includes a lower film layer, an upper film layer, and a spacer layer (not shown) separating the two film layers. The spacer layer has a through hole located directly under the keycap 140. The lower film layer and the upper film layer respectively include conductive contacts. When the keycap 140 is not pressed, the conductive contact on the upper film layer and the conductive contact on the lower film layer are separated on both sides of the spacer layer and are electrically separated. When the keycap 140 is pressed and moved toward the bottom plate 110, the keycap 140 will directly or indirectly push the upper film layer to partially enter the through hole of the spacer layer, so that the conductive contact on the upper film layer pass through the through hole to contact the conductive contact of the lower film layer (i.e., trigger behavior). Hence, the circuit board 120 can then generate a trigger signal corresponding to the pressed keyswitch device 100.

Figure 2:
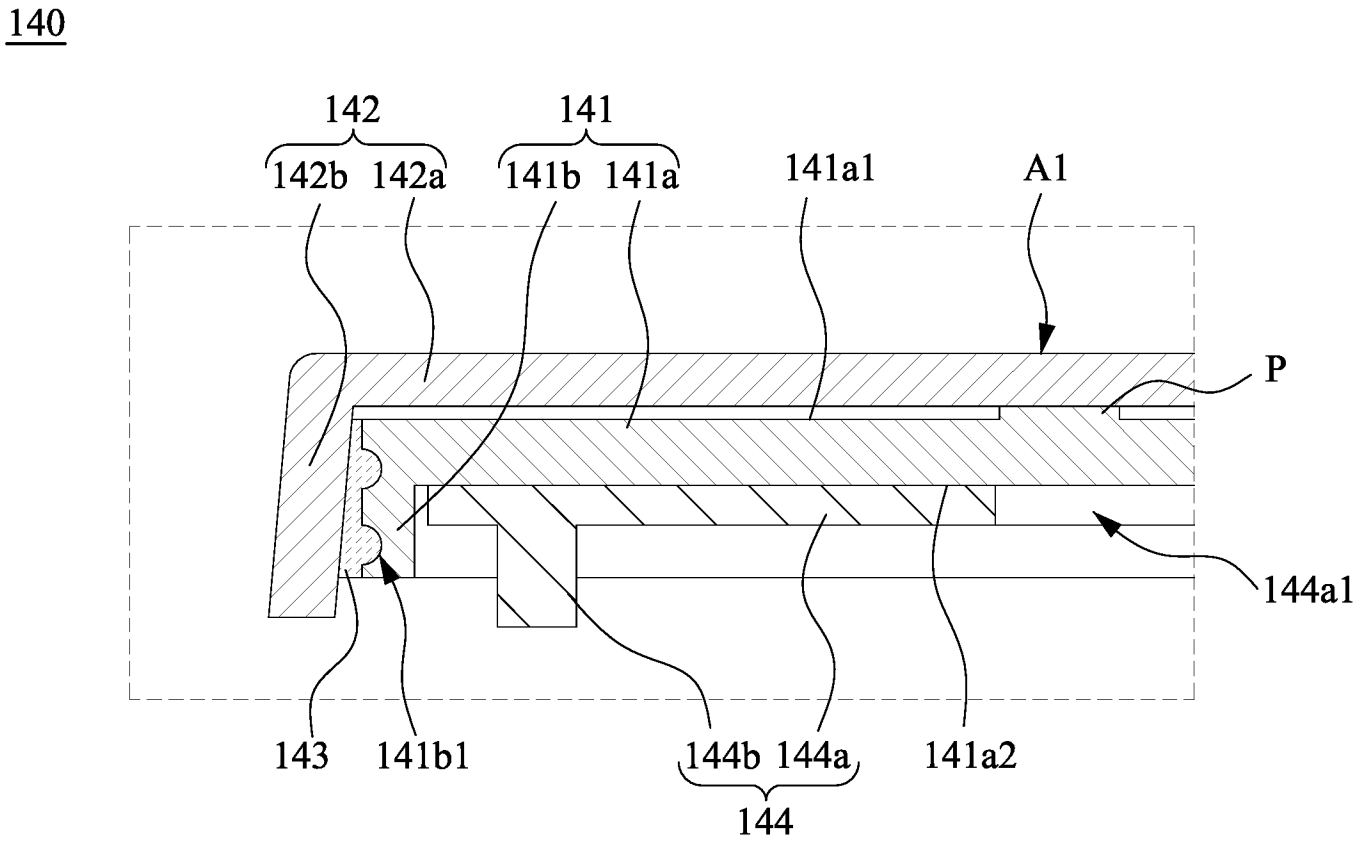
FIG. 2 is a partial cross-sectional view of a keycap shown in FIG. 1.

Reference is made to FIG. 2. FIG. 2 is a partial cross-sectional view of the keycap 140 shown in FIG. 1. As shown in FIGS. 1 and 2, the keycap 140 further includes a metal cover 141 and a covering member 142. The metal cover 141 includes a first main body 141*a*. The first main body 141*a* has a first surface 141*a*1 and a second surface 141*a*2 respectively facing toward and facing away from the bottom plate 110. The first surface 141*a*1 presents a pattern P (for example, the letter A shown in FIG. 1). The engaging structure 144 is fixed to the first main body 141*a* and disposed on the second surface 141*a*2 of the first main body 141*a*. The covering member 142 includes a second main body 142*a*. The second main body 142*a* covers the first surface 141*a*1 of the first main body 141*a*. The second main body 142*a* has a light-transmitting area A1 covering the pattern P. For example, the covering member 142 may be made of transparent plastic, so the entire second main body 142*a* can transmit light. Hence, the covering member 142 not only can allow the user to clearly recognize the pattern P on the first surface 141*a*1 of the first main body 141*a*, but also can protect the pattern P to prevent the pattern P from being worn after the keycap 140 is used for a long time.

In practical applications, the pattern P on the first surface 141*a*1 of the first main body 141*a* may be manufactured by an anodizing process, a printing process, a painting process, a stamping process, a laser engraving process, etc., but the present disclosure is not limited in this regard.

In addition, the position-returning member 150 passes through the engaging structure 144 to directly contact the first main body 141*a*. Hence, the heat accumulated on the top of the position-returning member 150 can be quickly transferred from the center of the metal cover 141 to the edge, thereby effectively avoiding the problem of heat accumulation between the center of the bottom of the keycap 140 and the top of the position-returning member 150.

In some embodiments, as shown in FIGS. 1 and 2, the engaging structure 144 includes an attaching portion 144*a* and the engaging portions 144*b*. The attaching portion 144*a* is attached to the second surface 141*a*2 of the first main body 141*a* and has a hollow portion 144*a*1. The engaging portions 144*b* are connected to the attaching portion 144*a* and arranged around the hollow portion 144*a*1. The position-returning member 150 passes through the hollow portion 144*a*1 to contact the first main body 141*a*. In some other embodiments, the attaching portion 144*a* may include a plurality of separating portions connected to the engaging portions 144*b*, respectively.

As shown in FIG. 2, the metal cover 141 further includes a first edge bending portion 141*b* connected to the first main body 141*a*. The first edge bending portion 141*b* is connected to at least one edge of the first main body 141*a*, and is bent relative to the first main body 141*a* to stand relative to the second surface 141*a*2. The covering member 142 further includes a second edge bending portion 142*b* connected to the second main body 142*a*. The second edge bending portion 142*b* is connected to at least one edge of the second main body 142*a* and opposite to the first edge bending portion 141*b*. The keycap 140 further includes an adhesive material 143 adhering the first edge bending portion 141*b* and the second edge bending portion 142*b*. Hence, the metal cover 141 and the covering member 142 can be firmly fixed to each other.

In some embodiments, as shown in FIG. 2, the first edge bending portion 141*b* has a plurality of recessed holes facing the second edge bending portion 142*b*. Parts of the adhesive material 143 are further accommodated in the recessed holes. Hence, the recessed holes 141*b*1 can provide additional space for accommodating the adhesive material 143, thereby effectively preventing the overflow of the adhesive material 143 from flowing to the components under the keycap 140 and causing failures or damages of the components.

In some embodiments, the recessed holes 141*b*1 on the first edge bending portion 141*b* may be the blind holes as shown in FIG. 1 (i.e., without running through the first edge bending portion 141*b*), but the present disclosure is not limited in this regard. In some other embodiments, the recessed holes 141*b*1 on the first edge bending portion 141*b* may be through holes.

In some embodiments, the adhesive material 143 is a kind of UV curing adhesive. After the adhesive material 143 is applied between the first edge bending portion 141*b* and the second edge bending portion 142*b*, UV light can then be transmitted through the covering member 142 to irradiate the adhesive material 143 to solidify the adhesive material 143.

Figure 3:
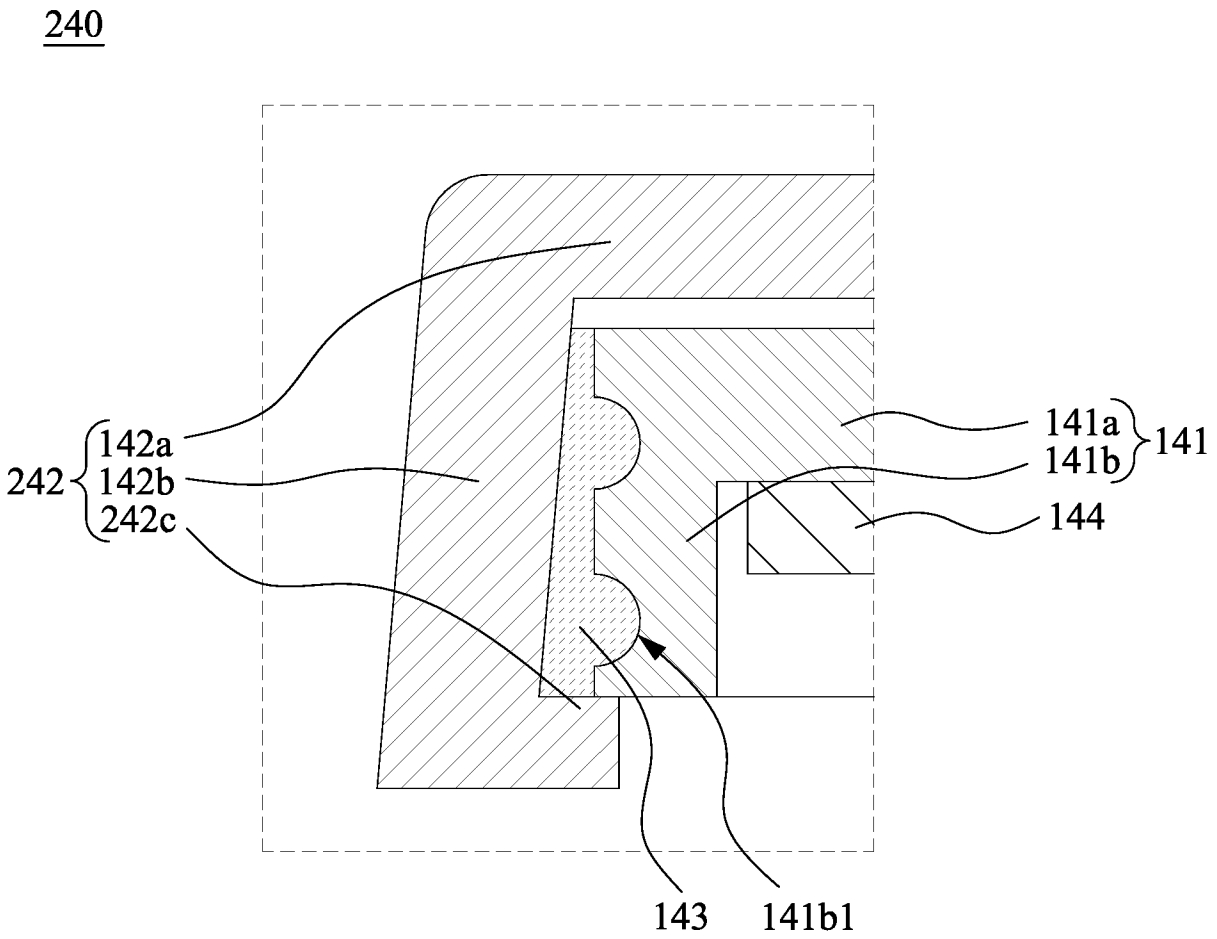
FIG. 3 is a partial cross-sectional view of a keycap according to another embodiment of the present disclosure.

Reference is made to FIG. 3. FIG. 3 is a partial cross-sectional view of a keycap 240 according to another embodiment of the present disclosure. As shown in FIG. 3, the keycap 240 includes a metal cover 141, a covering member 242, and an engaging structure 144, in which the metal cover 141 and the engaging structure 144 are identical or similar to those in the embodiment shown in FIG. 2, and therefore, reference may be made to the aforementioned related descriptions, which will not be repeated here. Compared with the covering member 142 shown in FIG. 2, the covering member 242 of the present embodiment further includes a buckling portion 242*c*. The buckling portion 242*c* is connected to the second edge bending portion 142*b* and buckles an edge of the first edge bending portion 141*b* away from the first main body 141*a*. In other words, the metal cover 141 is clamped between the second main body 142*a* and the buckling portion 242*c* of the covering member 242. Hence, the fixing strength between the metal cover 141 and the covering member 242 can be further increased.

Figure 4:
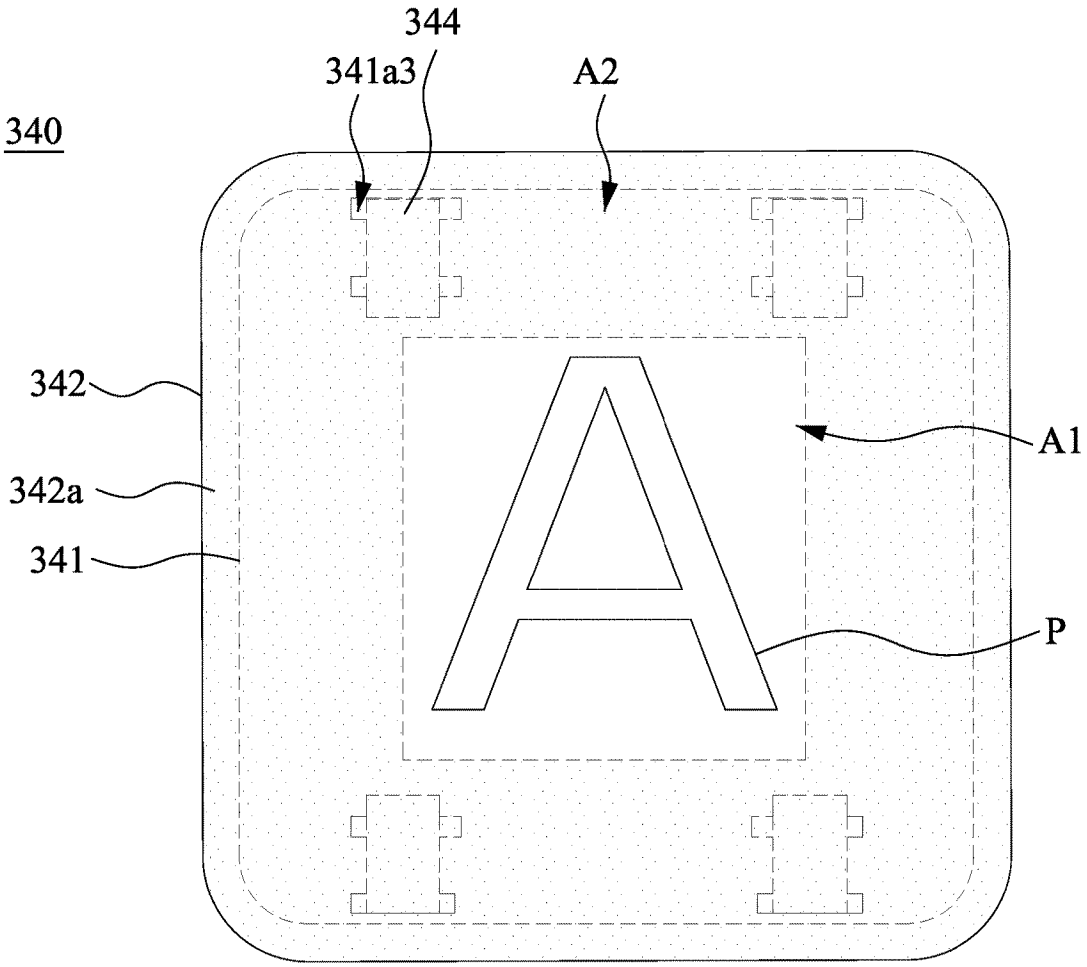
FIG. 4 is a top view of a keycap according to another embodiment of the present disclosure.
Figure 5:
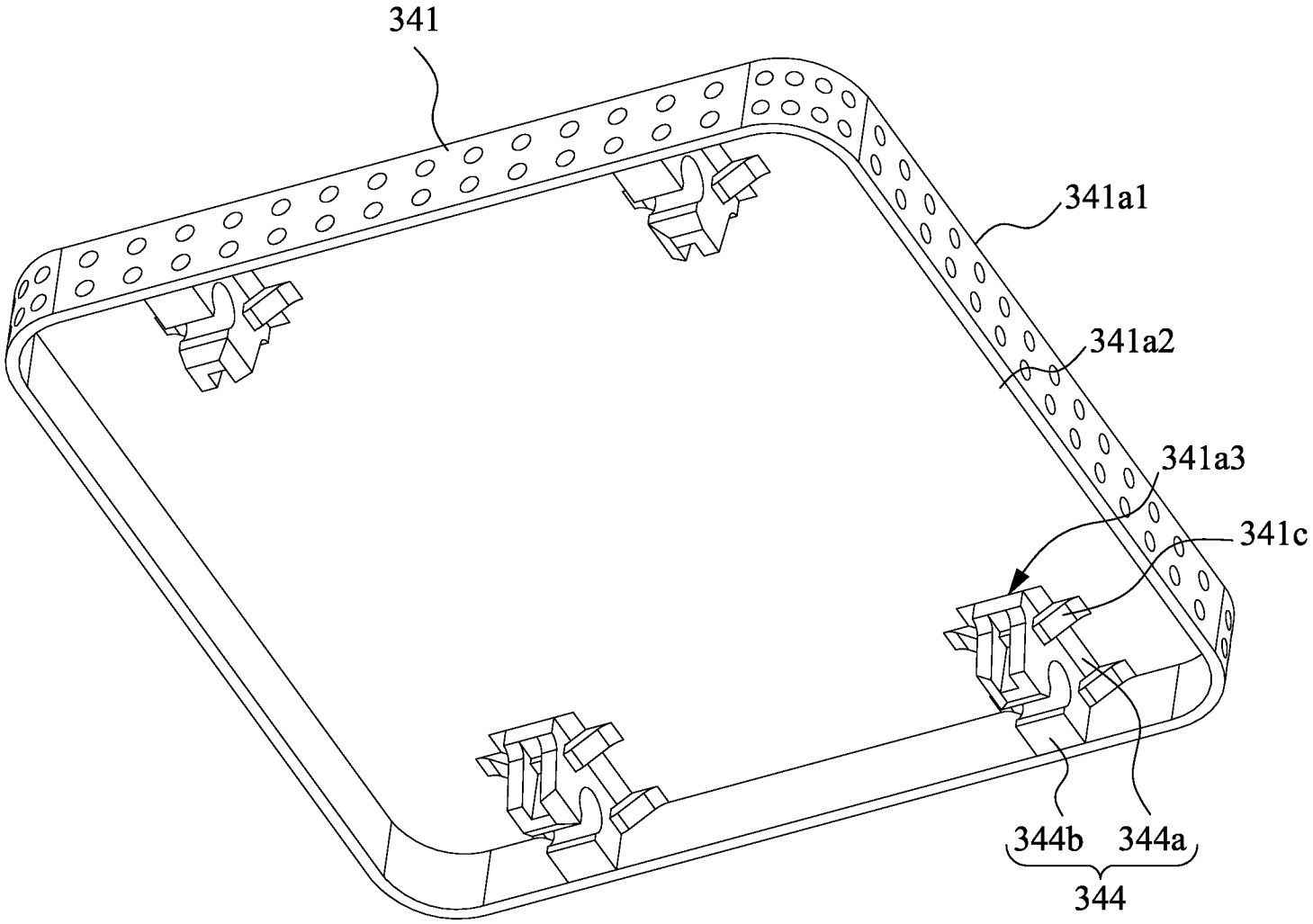
FIG. 5 is a perspective view of some components of the keycap shown in FIG. 4.
Figure 6:
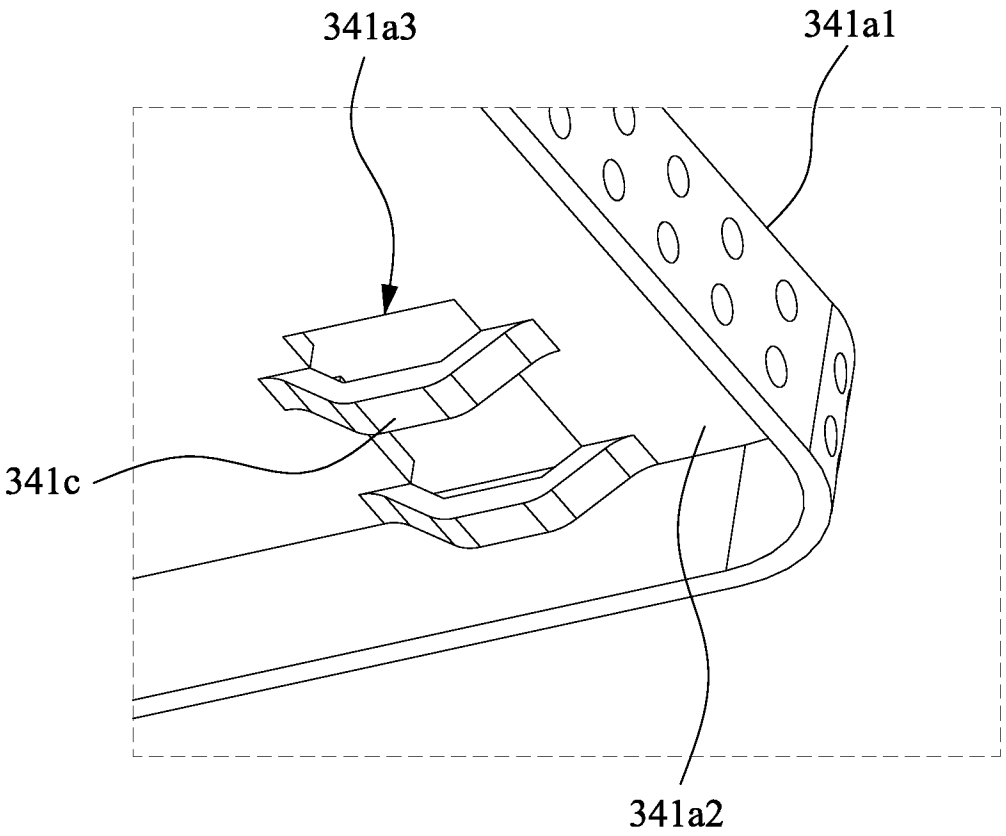
FIG. 6 is a partial enlarged view of a metal cover shown in FIG. 5.

Reference is made to FIGS. 4 to 6. FIG. 4 is a top view of a keycap 340 according to another embodiment of the present disclosure. FIG. 5 is a perspective view of some components of the keycap 340 shown in FIG. 4. FIG. 6 is a partial enlarged view of a metal cover 341 shown in FIG. 5. As shown in FIGS. 4 to 6, the keycap 340 includes a metal cover 341, a covering member 342, and a plurality of engaging structures 344. The first main body 341*a* of the metal cover 341 has a plurality of engaging holes 341*a*3. Each of the engaging holes 341*a*3 is communicated to the first surface 341*a*1 and the second surface 341*a*2 of the first main body 341*a*. The engaging structures 344 are embedded in the engaging holes 341*a*3, respectively. Specifically, each of the engaging structures 344 includes an embedding portion 344*a* and an engaging portion 344*b*. The embedding portion 344*a* is embedded in a corresponding one of the engaging holes 341*a*3. The embedding portion 344*a* is flush with the first surface 341*a*1 of the first main body 341*a*, so as to avoid installation obstacles when the covering member 342 is fixed to the metal cover 341 (for example, to prevent the covering member 342 from being inclined relative to the metal cover 341). The engaging portion 344*b* protrudes relative to the second surface 341*a*2 of the first main body 341*a*.

As shown in FIGS. 5 and 6, preferably, the metal cover 341 further includes a plurality of supporting ribs 341*c*. Each of the supporting ribs 341*c* is connected to the first main body 341*a* and penetrates a corresponding one of the engaging structures 344. Specifically, two ends of each of the supporting ribs 341*c* are connected to the first main body 341*a*. Furthermore, the supporting ribs 341*c* protrude from the second surface 341*a*2 of the first main body 341*a* and respectively cross the engaging holes 341*a*3. In other words, each of the supporting ribs 341*c* penetrates the engaging portion 344*b* of a corresponding one of the engaging structures 344. Hence, the problem that the engaging structures 344 fall off from the engaging holes 341*a*3 can be effectively avoided. In some embodiments, a material of the engaging structures 344 include plastic, and the engaging structures 344 can be manufactured through an injection molding process to be embedded into the engaging holes 341*a*3 and wrap parts of the supporting ribs 341*c*.

It should be noted that although FIG. 5 shows that each engaging hole 341*a*3 is crossed by corresponding two of the support ribs 341*c*, the number of the support ribs 341*c* is not limited to this and can be flexibly adjusted based on actual needs.

As shown in FIG. 4, the second main body 342*a* of the covering member 342 has a light-transmitting area A1 and a non-light-transmitting area A2. The light-transmitting area A1 covers the pattern P. The non-light-transmitting area A2 covers the engaging holes 341*a*3. Hence, the user can clearly recognize the pattern P through the light-transmitting area A1 of the covering member 342, and the non-light-transmitting area A2 of the covering member 342 can shield the engaging holes 341*a*3 to avoid affecting the visual appearance provided by the keycap 340 to the user. For example, the covering member 342 may be made of transparent plastic, and a light-shielding layer may be formed thereon through a printing process or a spray paint process, so that the portion of the covering member 342 that is not provided with the light-shielding layer and the portion of the covering member 342 that is provided with the light-shielding layer can form the light-transmitting area A1 and the non-light-transmitting area A2, respectively.

In some embodiments, as shown in FIG. 4, the non-light-transmitting area A2 is ring-shaped and surrounds the light-transmitting area A1, but the present disclosure is not limited in this regard.

According to the foregoing recitations of the embodiments of the disclosure, it can be seen that in the keyswitch device of the present disclosure, by covering the pattern of the metal cover by the covering member, the problem that the pattern is worn out after the keycap is used for a long time can be avoided. In addition, by making the position-returning member under the keycap directly contact the metal cover, the problem of heat accumulation between the center of the bottom of the keycap and the top of the position-returning member can be effectively avoided.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyswitch device, comprising:

a bottom plate;

a keycap comprising:

a metal cover comprising a first main body and a first edge bending portion, the first main body having a first surface and a second surface respectively facing toward and facing away from the bottom plate and an engaging hole communicated to the first surface and the second surface, the first surface presenting a pattern, the first edge bending portion being connected to the first main body;

a covering member comprising a second main body and a second edge bending portion, the second main body covering the first surface and having a light-transmitting area covering the pattern, the second edge bending portion being connected to the second main body;

an adhesive material adhering the first edge bending portion and the second edge bending portion; and an engaging structure fixed to the first main body and protruding from the second surface, wherein the engaging structure is embedded in the engaging hole;

a position-returning member disposed between the bottom plate and the keycap and contacting the first main body; and a connecting assembly connected between the bottom plate and the engaging structure and configured to guide the keycap to move upward and downward relative to the bottom plate.

2. The keyswitch device of claim 1, wherein the engaging structure is attached to the second surface and has a hollow portion, and the position-returning member passes through the hollow portion to contact the first main body.

3. The keyswitch device of claim 1, wherein the metal cover further comprises a supporting rib, and the supporting rib is connected to the first main body and penetrates the engaging structure.

4. The keyswitch device of claim 3, wherein the supporting rib protrudes from the second surface and crosses the engaging hole.

5. The keyswitch device of claim 1, wherein the second main body has a non-light-transmitting area covering the engaging hole.

6. A keyswitch device, comprising:

a bottom plate;

a keycap comprising:

a metal cover comprising a first main body and a first edge bending portion, the first main body having a first surface and a second surface respectively facing toward and facing away from the bottom plate, the first surface presenting a pattern, the first edge bending portion being connected to the first main body;

a covering member comprising a second main body and a second edge bending portion, the second main body covering the first surface and having a light-transmitting area covering the pattern, the second edge bending portion being connected to the second main body, wherein the first edge bending portion has at least one recessed hole facing the second edge bending portion; and an adhesive material adhering the first edge bending portion and the second edge bending portion, wherein a part of the adhesive material is accommodated in the at least one recessed hole; and a position-returning member disposed between the bottom plate and the keycap and contacting the first main body.

7. A keyswitch device, comprising:

a bottom plate;

a keycap comprising:

a metal cover comprising a first main body and a first edge bending portion, the first main body having a first surface and a second surface respectively facing toward and facing away from the bottom plate, the first surface presenting a pattern, the first edge bending portion being connected to the first main body; and a covering member comprising a second main body, a second edge bending portion, and a buckling portion, the second main body covering the first surface and having a light-transmitting area covering the pattern, the second edge bending portion being opposite to the first edge bending portion, the buckling portion being connected to the second edge bending portion and buckling an edge of the first edge bending portion away from the first main body; and a position-returning member disposed between the bottom plate and the keycap and contacting the first main body.

* * * * *